US005747800A

United States Patent [19]

Yano et al.

[11] Patent Number: 5,747,800

[45] Date of Patent: May 5, 1998

[54] THREE-DIMENSIONAL QUADRUPOLE MASS SPECTROMETER

[75] Inventors: Masayoshi Yano; Kohei Mochizuki, both of Hitachinaka, Japan

[73] Assignee: Hitachi, Ltd., Tokyo, Japan

[21] Appl. No.: 749,269

[22] Filed: Nov. 13, 1996

[30] Foreign Application Priority Data

Dec. 13, 1995 [JP] Japan ..... 7-324478

[51] Int. Cl.[6] ..... H01J 49/42

[52] U.S. Cl. ..... 250/292; 250/281

[58] Field of Search ..... 250/292, 281, 250/288, 288 A, 423 R, 427

[56] References Cited

U.S. PATENT DOCUMENTS 4,755,670 7/1988 Syka et al. ..... 250/292

5,105,081 4/1992 Kelley ..... 250/292

5,302,827 4/1994 Foley ..... 250/292

5,572,022 11/1996 Schwartz et al. ..... 250/292

5,572,035 11/1996 Franzen ..... 250/292

*Primary Examiner*—Kiet T. Nguyen

*Attorney, Agent, or Firm*—Kenyon & Kenyon

[57] ABSTRACT

A three-dimensional quadrupole mass spectrometer is suitable for preventing occurrence of a situation where the mass spectrometry cannot be conducted by an excessive existence of ions in a three-dimensional ion confining space, an amount of ions emitted from an ion source 1 is detected by a first electrode 3 of a lens, an output signal therefrom is inputted to a power supply 17 of a second electrode 4 of the lens and a focusing condition of ions caused by the lens is changed such that an amount of ions existing in the three-dimensional ion confining space does not exceed a certain level.

19 Claims, 5 Drawing Sheets

THREE-DIMENSIONAL QUADRUPOLE MASS SPECTROMETER

BACKGROUND OF THE INVENTION

The present invention relates to a three-dimensional quadrupole mass spectrometer.

When a high frequency voltage (a d.c. voltage in addition thereto as necessary) is applied among two opposed endcap electrodes and a ring electrode provided between the endcap electrodes and ions are made to exist in a three-dimensional quadrupole electric field formed by these electrodes, ions perform a constant motion that is determined by the formed electric field and continue to exist in the electric field. In this case ions which are not in compliance with a set condition of the electric field are repelled to the outside of the electric field. Accordingly, the mass spectrometry can be carried out by continuously changing the electric field condition and taking out ions existing in the electric field to the outside of the electric field in an order of smaller mass numbers or in an order of larger mass numbers.

According to a method of forming ions existing in the electric field in accordance with the mass spectrometry, an electron stream is injected from one end of the endcap electrodes into the three-dimensional quadrupole electric field and made to impinge on sample molecules separately introduced into the three-dimensional quadrupole electric field in a gaseous form (electron impingement ionization: referred to as EI) thereby ionizing the sample molecules. According to this method, when a large amount of sample gas is introduced and ions are formed above an allowable amount of existence in the electric field, impingement among ions or between ions and sample molecules occurs to thereby constitute an amount of ions different from a correct sample existence amount whereby the correct analysis may not be carried out.

Further, it is also possible to form ions outside of a three-dimensional quadrupole electric field. A similar phenomenon occurs also in this case when ions are injected into the electric field without controlling the amount of the introduced ions.

Incidentally, three-dimensional quadrupole mass spectrometers are described, for example, in U.S. Pat. No. 3,065,640, U.S. Pat. No. 4,755,670, Japanese Patent Laid-open No. Hei 1-258353 and the like.

As described above, when an amount of ions in a three-dimensional quadrupole electric field is larger than the allowable amount of existence of ions in the electric field, the mass spectrometry may not be performed.

SUMMARY OF THE INVENTION

The present invention to provide a three-dimensional quadrupole mass spectrometer suitable for preventing occurrence of such a situation where the mass spectrometry cannot be performed.

The invention to provide a three-dimensional quadrupole mass spectrometer suitable for automatically preventing occurrence of the above-described situation where the mass spectrometry cannot be performed.

According to a three-dimensional quadrupole mass spectrometer in accordance with the present invention, ions are formed, a three-dimensional quadrupole electric field is formed in a three-dimensional ion confining space such that the formed ions are confined into the three-dimensional ion confining space, ions having a desired mass/charge ratio are emitted from the three-dimensional ion confining space and an amount of the ions existing in the three-dimensional ion confining space is detected.

Therefore, the amount of ions existing in the three-dimensional ion confining space can be adjusted such that the amount is not equal to or more than the allowable amount by determining the result of detection. Therefore, according to the present invention a three-dimensional quadrupole mass spectrometer suitable for preventing occurrence of the above-described situation where the mass spectrometry cannot be performed.

The formation of ions may be performed outside of the three-dimensional ion confining space or may be performed inside thereof. In the case of forming ion outside thereof, the amount of ions existing in the three-dimensional ion confining space can be adjusted by changing a condition of focusing ions when ions formed by an ion forming means are introduced into the three-dimensional ion confining space. The amount of ions existing in the three-dimensional ion confining space may naturally be adjusted by changing the amount per se of ions to be formed which are formed by the ion forming means. Meanwhile, in the case of forming ion inside, the amount of the ions existing in the three-dimensional ion confining space can be adjusted by changing the amount per se of ions to be formed which are formed by the ion forming means.

According to the three-dimensional quadrupole mass spectrometer in accordance with the present invention, ions are formed, a three-dimensional quadrupole electric field is formed in a three-dimensional ion confining space such that formed ions are confined in the three-dimensional ion confining space, ions having a desired mass/charge ratio are emitted from the three-dimensional ion confining space, an amount of ions is detected such that an electric signal corresponding to the amount of ions existing in the three-dimensional ion confining region is generated and the amount of ions existing in the three-dimensional ion confining space is controlled such that the amount of ions does not substantially exceed a predetermined level, based on the generated electric signal.

Therefore, the three-dimensional quadrupole mass spectrometer suitable for preventing automatically occurrence of the situation where the mass spectrometry cannot be performed, is provided.

The other objects and characteristics of the present invention will be clarified by an explanation of the following embodiments in reference to the drawings.

DETAILED DESCRIPTION

Figure 1:
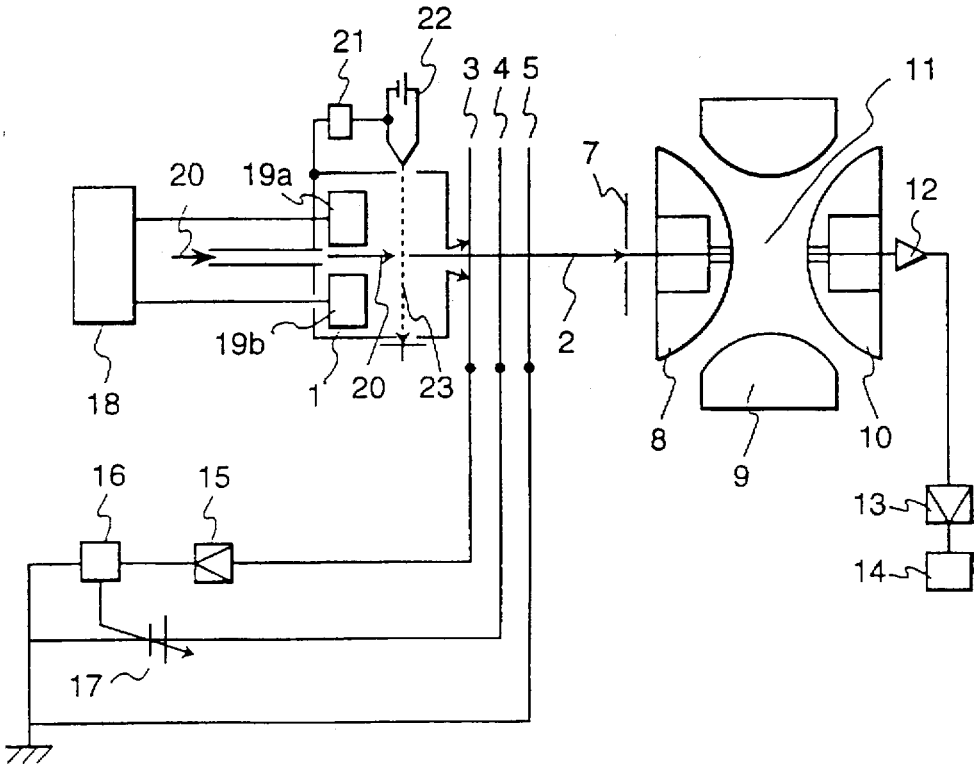
FIGS. 1(*a*), 1(*b*) and 1(*c*) are views of a three-dimensional quadrupole mass spectrometer showing an embodiment in accordance with the present invention where FIG. 1(*a*) is an outline view of the total constitution and FIGS. 1(*b*) and 1(*c*) are outline views of an ion source.
Figure 1:
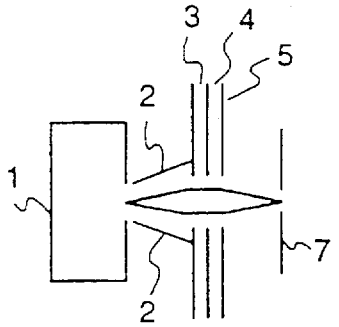
Figure 1:
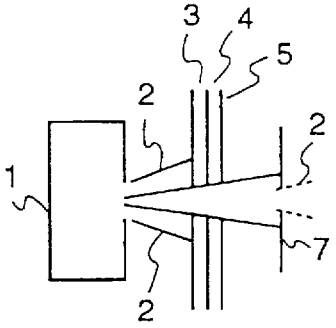

In reference to FIG. 1(*a*), electrons emitted from a filament 22 is accelerated by an electric voltage of an electron accelerating power supply 21 that is applied between an ion source 1 and the filament 22 thereby constituting an electron stream 23 which is caught by a collector after passing through the ion source 1. Accordingly, a gas sample 20 introduced from the outside of the ion source 1 into the inside thereof (The gas sample is generally a component of gas sample that is separated by a gas chromatograph (GC) or a liquid chromatograph (LC).) is ionized by electron impingement and ions 2 formed thereby are emitted from an emitting port of the ion source 1. Ions moving in a direction opposite to the emitting port among formed ions are repelled by a repeller voltage provided by repeller electrodes 19*a* and 19*b* from a repeller electrode power supply 18 and are effectively emitted from an emitting port.

The emitted ions are introduced to a three-dimensional quadrupole mass spectrometry unit after passing through a lens constituted by a first, a second and a third electrode 3, 4 and 5 and further passing through a slit 7. The three-dimensional quadrupole mass spectrometry unit includes a ring electrode 9 having a contour of hyperboloid of revolution and endcap electrodes 8 and 10 having a contour of hyperboloid which are arranged at both sides of the ring electrode 9. Although not illustrated, a d.c. voltage and a high frequency voltage are applied between the ring electrode 9 and the endcap electrodes 8 and 10 whereby a three-dimensional quadrupole electric field is formed at the inside of the three-dimensional quadrupole mass spectrometry unit. This electric field space is designated by numeral 11 in the drawing.

The d.c. voltage may be applied or may be zero. In any case, as is well known, ions belonging to a stable region of a stability diagram of ion, not illustrated, are confined in the three-dimensional quadrupole electric field space 11. Therefore, the electric field space can be referred to as a three-dimensional ion confining space. It is the principle of the three-dimensional quadrupole mass spectrometry to separate by mass separation only ions having the object of mass number, that is, mass/charge ratio among stably confined ions and taking out the ions from the three-dimensional ion confining space 11 to the outside thereof.

There are two main methods for taking out ions having the object of mass number. According to one of the methods (normal method), oscillation of ions having different mass numbers is made unstable by gradually changing a high frequency voltage and the ions that are made unstable are emitted from the three-dimensional ion confining space 11 to the outside. According to the other one of the methods (resonance emitting method), an auxiliary a.c. electric field (power supply therefor is not illustrated) having a frequency the same as the natural frequency of ions having a mass number which are intended to take out, is further formed in the three-dimensional ion confining space 11 and ions are emitted from the three-dimensional ion confining space 11 to the outside by amplifying the amplitude of oscillation of the ions.

In this case, although there are several methods for forming the auxiliary a.c. electric field, according to the most general method, auxiliary a.c. voltages which are provided with a specific frequency and which are shifted from each other by a half phase, are provided to the pair of endcap electrodes from an auxiliary power supply. Thereby, the auxiliary electric field oscillating at a specific period is formed and ions are emitted by being resonant with an auxiliary a.c. voltage in accordance with the mass/charge ratio of respective ions, that is, the mass numbers. At this occasion the natural frequency of each ion species is also scanned by scanning the amplitude of the main high frequency voltage. Therefore, when the auxiliary a.c. voltage having a specific frequency is applied and the amplitude of the main high frequency voltage is scanned, the mass number of ions emitted by the resonance is also scanned.

The ions which have been subjected to the mass spectrometry as described above are detected by an ion detector 12 and the result of detection is converted to an electric signal. The electric signal is introduced into a data processing device 14 via an amplifier 13 and various processings are performed in respect of the electric signal.

The first electrode 3 constituting the lens also functions as an ion detector for detecting ions (total ions) emitted from the ion source 1 and therefore, the first electrode 3 is connected to a computer/control device 16 via an amplifier 15. A high voltage is applied from a variable electrode power supply 17 to the second electrode 4 and the variable electrode power supply 17 is made variable based on a signal from the computer/control device 16. The third electrode 5 is grounded.

Ions other than those passing through an ion passing hole of the first electrode 3 among ions emitted from the ion source 1, are detected by the first electrode 3 and the detection result is converted to an electric signal. The gas sample introduced into the ion source 1 is generally a component of a gas sample separated by the gas chromatograph (GC) or liquid chromatograph (LC) and therefore, the converted electric signal constitutes a peak-like shape in correspondence with the separated sample component. The provided result is generally referred to as chromatogram. The converted electric signal is introduced into the computer/control device 16 via the amplifier 15 and the computer and control device 16 changes an output of the variable electric source 17 based on the introduced electric signal. Thereby, the high voltage applied on the second electrode 4 is changed whereby the amount of ions introduced into the three-dimensional ion confining space, that is, the amount of ions existing at the inside thereof is changed.

That is, when the voltage applied on the second electrode 4 is provided with a certain value, ions are focused to the slit 7 as illustrated by FIG. 1(*b*) and when the applied voltage is zero, the focusing effect with respect to the ions is not provided as illustrated by FIG. 1(*c*). Accordingly, it is known that the amount of ions introduced into the three-dimensional ion confining space 11 via the slit 7, that is, the amount of ions existing in the space can be changed by changing the voltage applied on the second electrode 4 to change the focusing condition of ions by the lens.

There is a specific relationship between the amount of ions detected by the first electrode 3 and the amount of ions existing in the three-dimensional ion confining space 11 and therefore, the amount of ions existing in the three-dimensional ion confining space 11 can be estimated by the amount of ions detected by the first electrode 3. Hence, a specific threshold level in respect of the electric signal provided to the computer and control unit 16, which is determined based on an allowable value of the amount of ions capable of existing in the three-dimensional ion confining space 11, is set and the computer/control device 16 executes the control such that the electric signal does not exceed the threshold level.

Figure 2:
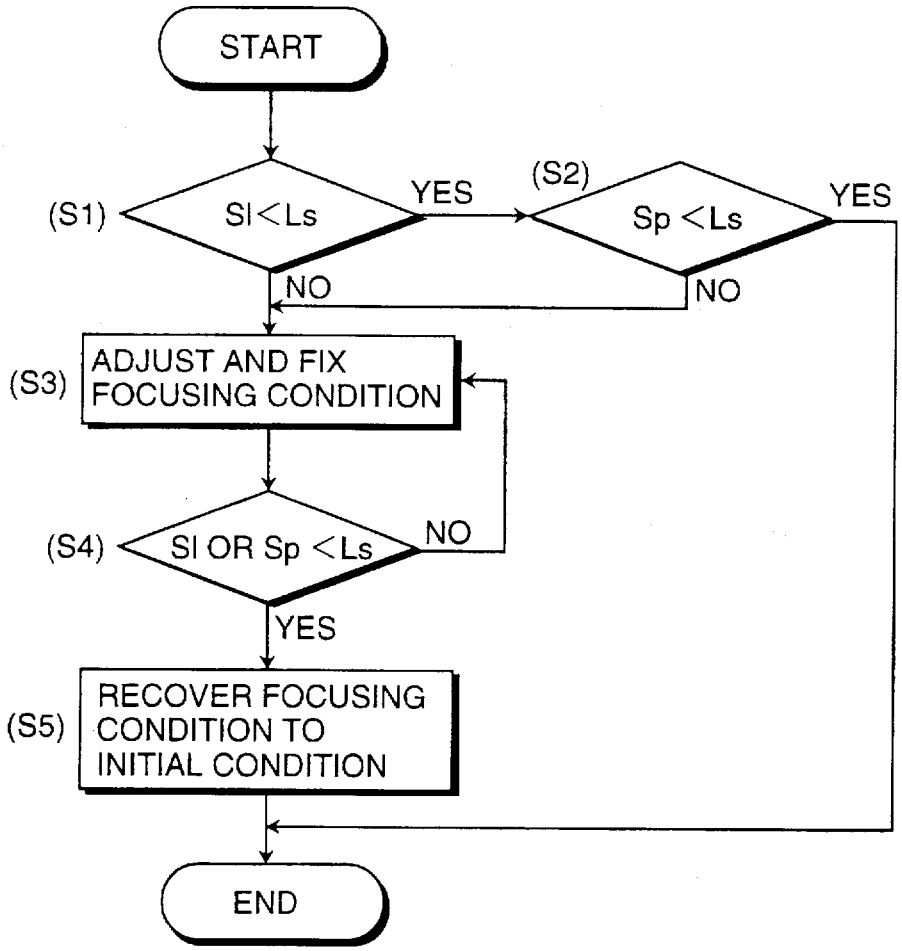
FIG. 2 is a diagram showing an operational flow chart as an example of FIG. 1.

An explanation will be given of this point in reference to the flow chart of FIG. 2. To simplify the explanation an instantaneous value of the electric signal introduced into the computer/control device 16 via the amplifier 15 is designated by SI, a peak value thereof is designated by SP and the threshold level which is predetermined in respect of the electric signal based on the allowable amount of ions capable of existing in the three-dimensional ion confining space 11 is designated by LS.

When the ionization is started, SI initially provided with a value of zero increases as time elapses. In step S1 a determination of whether SI is larger than LS is conducted. When SI does not reach LS, a determination of whether SP is smaller than LS is conducted in step S2 and when SP is smaller than LS, the flow is finished.

Meanwhile, when it is determined that SI is equal to LS in step S1, or when SP is equal to LS in step S2, the focusing condition by the lens in respect of ions introduced into the three-dimensional quadrupole electric field space, that is, the three-dimensional ion confining space 11 via the slit 7, is changed and fixed such that SI or SP does not exceed LS. The change of the focusing condition is naturally achieved by adjusting the electrode power supply 17 based on SI or SP to change the voltage applied on the second electrode 4.

The above-mentioned statement of "not exceed" has the strictness and therefore, the exceeding the threshold in an actually allowable range is included in the range of the meaning of the statement "not exceed". Further, when a phenomenon of SI=LS and a phenomenon of SP=LS simultaneously occur, either of the phenomena may have the priority.

Thereafter, a determination of whether SI or SP is smaller than LS is continued in step 3 and when SI or SP is smaller than LS (step 4), the focusing condition of ions caused by the lens which has been changed and fixed in step 3 is recovered to a focusing condition (initial condition) before the change (step 5) whereby the flow is finished. The above-described operation is repeated at every occurrence of the ion peak.

With respect to the detector of total ions, the first electrode 3 may be used as in the embodiment of FIG. 1. However, it may be provided separately from the electrode 3.

It is understandable from the above-described explanation that the amount of ions existing in the three-dimensional ion confining space 11 can be prevented from exceeding substantially the allowable value whereby ions can exist in the space.

Figure 3:
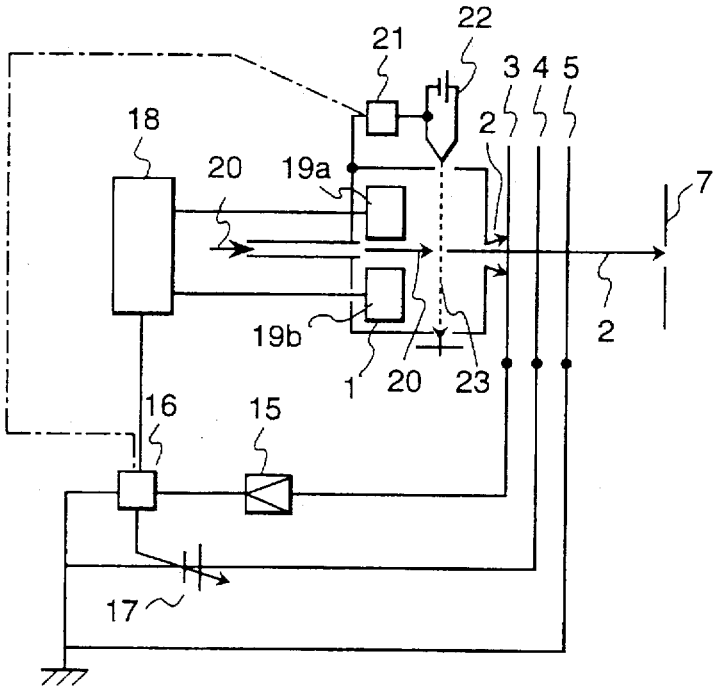
FIG. 3 is an outline view of essential portions of a three-dimensional quadrupole mass spectrometer showing another embodiment in accordance with the present invention.

FIG. 3 indicates essential portions of another embodiment in accordance with the present invention and the difference thereof from the embodiment as illustrated by FIG. 1, resides in that although the amount of ions introduced into the three-dimensional ion confining space 11 is changed by adjusting the variable power supply 17 according to the embodiment of FIG. 1 to change the focusing condition of ions caused by the lens, the amount of ions is changed by adjusting the output of the repeller electrode power supply 18 to change the repeller voltage provided to the repeller electrodes 19*a* and 19*b*. The amount of ions emitted from the ion source 1, that is, the amount of ions formed by the ion source 1 can be changed also in this embodiment and therefore, the amount of ions existing in the three-dimensional ion confining space 11 can be changed similar to the embodiment of FIG. 1.

The amount of ions formed by the ion source 1 can be changed also by changing the electron accelerating voltage provided by the electron accelerating power supply 21 instead of changing the repeller voltage. Therefore, the amount of ions existing in the three-dimensional ion confining space can be changed similarly in this case. A system designated by a one-dotted chain line in FIG. 3 indicates the control system.

Figure 4:
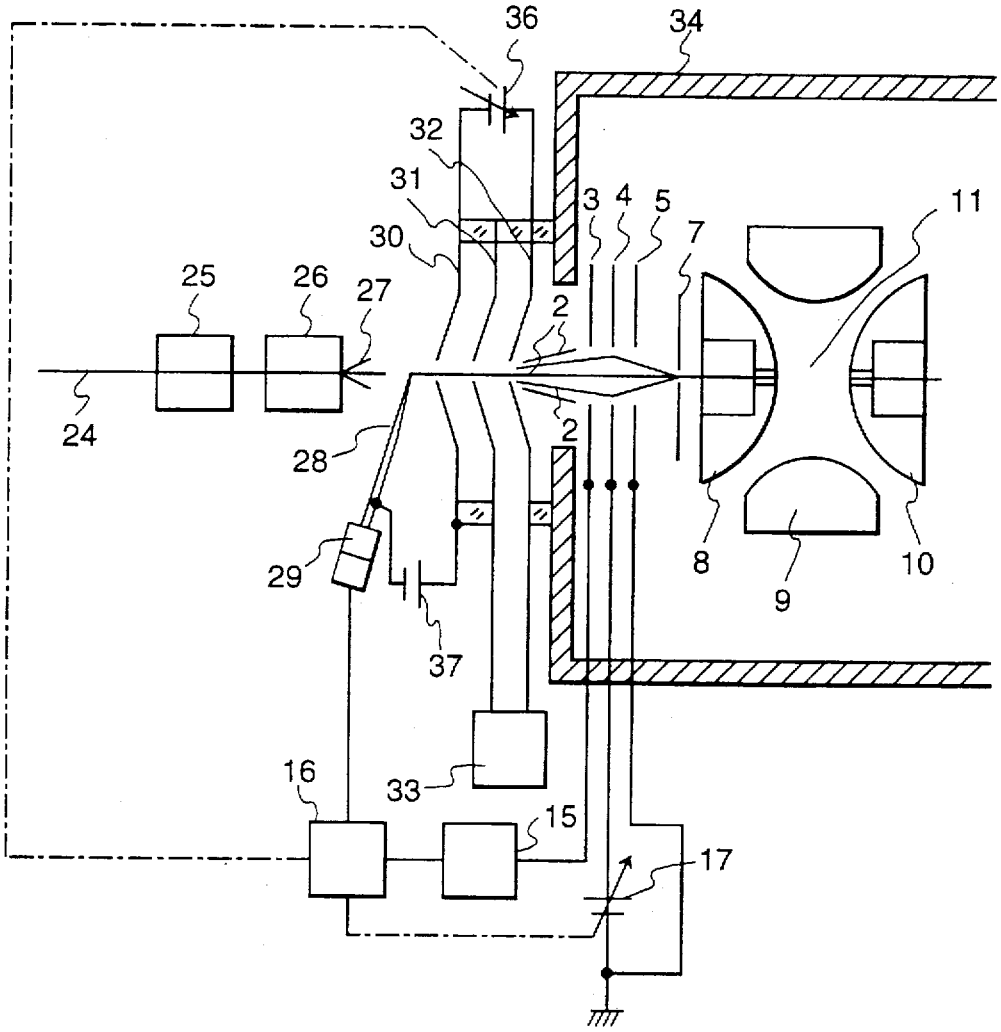
FIG. 4 is an outline view of essential portions of a three-dimensional quadrupole mass spectrometer showing still another embodiment in accordance with the present invention.

FIG. 4 shows essential portions of still another embodiment in accordance with the present invention. This embodiment shows an example in the case where the device is coupled with a liquid chromatograph.

A solution 24 flowing out from a liquid chromatograph (LC), not illustrated, is atomized by an atomizer 25 and a solvent is removed by a solvent remover 26 whereby a sample gas stream 27 is constituted.

A high voltage is applied between a needle electrode 28 that is a corona discharge electrode and a first fine hole electrode 30 by a high voltage power supply 37 and accordingly, the atomized sample gas stream is ionized by the corona discharge under an atmospheric pressure. Formed ions are passed through an intermediate electrode 31 and a second fine hole electrode 32 to constitute the ion stream 2. The ion stream 2 is introduced into a vacuum vessel 34. The ion stream 2 is diverged after passing through the second fine hole electrode 32 but focused by the lens constituted by the first, the second and the third electrodes 3, 4 and 5 and is introduced into the three-dimensional quadrupole electric field space 11 via the slit 7.

As in the embodiment of FIG. 1, the third electrode 5 is grounded, the variable power supply 17 is connected to the second electrode 4 and the computer/control device 16 is connected to the first electrode 3 via the amplifier 15. Similar to the embodiment of FIG. 1 ions which is caused to impinge on the first electrode 3 are converted into an electric signal by the electrode 3 and the electric signal is introduced into the computer/control device 16 via the amplifier 15.

The computer/control device 16 drives an electrode driving device 29 based on the introduced electric signal whereby the needle electrode 28 is moved in the axial direction. Thereby, the position of the needle electrode 28 is changed and accordingly, the degree of the corona discharge is changed whereby the amount of ions to be formed is changed. In this way the amount of ions existing in the three-dimensional ion confining space 11 can be controlled such that the amount does not substantially exceed a predetermined level.

Instead of moving the needle electrode 28, the output of the power supply 17 for providing a high voltage to the second electrode 4 may naturally be made variable as in the embodiment of FIG. 1. Further, an output from a variable power supply 36 applied between the first fine hole electrode 30 and the second fine hole electrode 32 may be made variable.

Incidentally, numeral 33 designates an exhaust system for exhausting gas in a space between the intermediate electrode 31 and the second fine hole electrode 32 to maintain it at an intermediate pressure.

Figure 5:
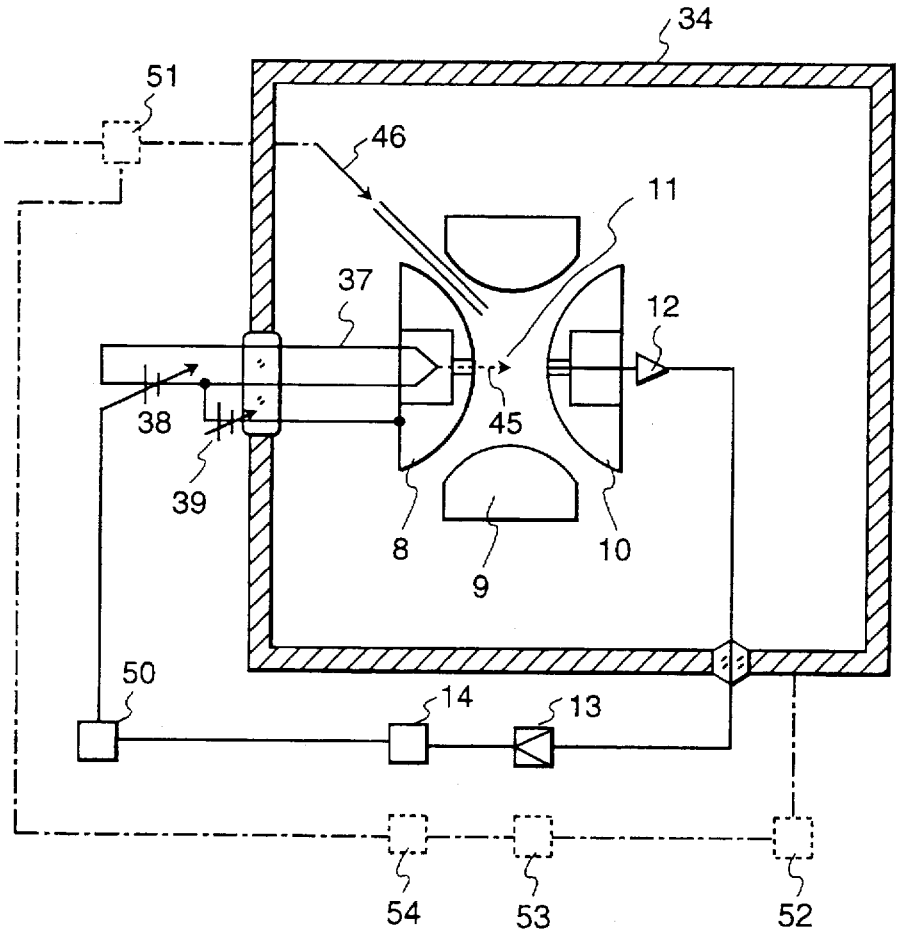
FIG. 5 is an outline view of a total of a three-dimensional quadrupole mass spectrometer showing still another embodiment in accordance with the present invention.

Although the above-described embodiments are in respect of a type where the ion forming means are arranged outside of the three-dimensional ion confining space 11, the present invention is applicable to a type where the ion formation is executed in the three-dimensional ion confining space 11. FIG. 5 shows an embodiment of this type.

In FIG. 5 electrons are emitted from a filament 37 heated by a variable filament power supply 38 and the electrons are accelerated toward the three-dimensional ion confining space 11 by an accelerating voltage provided by a variable accelerating power supply 39. Therefore, when a gas sample 46 is introduced into the three-dimensional ion confining space 11, the gas sample is subjected to electron impingement to be ionized. The formed ions are subjected to the mass spectrometry under the same principle as explained in respect of the embodiment of FIG. 1. The ions which have been subjected to the mass spectrometry are detected by the ion detector 12 and then is converted into an electric signal. The electric signal is introduced into the data processing device 14 via the amplifier 13 where various processings are conducted in respect of the electric signal.

A control device 50 changes the filament current, that is, the amount of ions to be formed by adjusting the variable filament power supply 38, in accordance with the amount of ions existing in the three-dimensional ion confining space 11, based on the electric signal provided to the data processing device 14 via the amplifier 13. Thereby, the amount of ions existing in the three-dimensional ion confining space 11 can be controlled such that the amount does not substantially exceed an allowable limit thereof. Specifically, the amount of total ions in the scanning range of all the mass numbers or in the range of limited mass numbers, may be calculated by the data processing device 14 and the variable filament power supply 38 may be adjusted based on the signal. Or a peak signal of an ion originated from a specific substance (for example, GC carrier gas, solvent of sample solution of LC, a substance predictable to exist especially in a large amount etc.) may be detected and the variable filament power supply 38 may be adjusted based on the signal.

Instead of adjusting the variable filament power supply 38, the amount of the sample 46 introduced into the three-dimensional ion confining space 11 may be adjusted by adjusting a flow rate adjuster 51, by which the amount of forming ions may be changed.

Further, in addition to the fact that the amount of ions to be formed in the three-dimensional ion confining space 11 is a function of the amount of sample introduced into the space, the amount of sample is in a constant relationship with the degree of vacuum in the three-dimensional space 11, that is, the degree of vacuum inside of the vacuum vessel 34. Therefore, the degree of vacuum of the vacuum vessel 34 may be detected by a vacuum meter 52 and converted into an electric signal. The converted electric signal may be introduced into a control device 54 via an amplifier 53 and the flow rate adjuster 51 may be adjusted by the control device 54 based on the electric signal. Also in this way the amount of sample introduced into the three-dimensional ion confining space 11, that is, the amount of ions existing in the space can be controlled such that the amount does not substantially exceed the allowable limit.

In this way, the three-dimensional quadrupole spectrometer suitable for preventing occurrence of the situation where the mass spectrometry cannot be performed by the excessive existence of ions in the three-dimensional ion confining space, can be provided. Further, the three-dimensional quadrupole mass spectrometer suitable for preventing automatically occurrence of the situation where the mass spectroscopy cannot be performed by the excessive existence of ions in the three-dimensional ion confining space, can be provided.

What is claimed is:

1. A three-dimensional quadrupole mass spectrometer comprising: an ion former for forming ions;

electrodes for forming an electric field in a three-dimensional ion confining space;

a voltage controller for forming a three-dimensional quadrupole electric field in the three-dimensional ion confining space by applying a periodic voltage to the electrodes such that said ions formed by the ion former are confined into the three-dimensional ion confining space, wherein the voltage controller controls the periodic voltage such that said ions having a desired mass/charge ratio are emitted from the three-dimensional ion confining space;

a detector for detecting an estimated amount of said ions existing in the three-dimensional ion confining space by detecting the ions before entering the three-dimensional ion containing space; and a restrictor to restrict ion density being introduced to the three-dimensional ion confining space.

2. The three-dimensional quadrupole mass spectrometer according to claim 1, wherein the ion former is arranged outside of the three-dimensional ion confining space such that the formed ions are introduced into the three-dimensional ion confining space and the detector is arranged between the ion former and the three-dimensional ion confining space.

3. A three-dimensional quadrupole mass spectrometer comprising:

an ion former for forming ions;

electrodes for forming an electric field in a three-dimensional ion confining space;

a voltage controller for forming a three-dimensional quadrupole electric field by applying a periodic voltage to the electrodes such that said ions formed by the ion former are confined to the three-dimensional ion confining space; wherein the voltage controller controls the periodic voltage such that said ions having a desired mass/charge ratio are emitted from the three-dimensional ion confining space;

a detector for detecting an estimated amount of said ions by detecting the ions before entering the three-dimensional containing space and generating an electric signal corresponding to the amount of the estimated amount of ions existing in the three-dimensional ion confining space; and a restrictor restricting the amount of the ions existing in the three-dimensional ion confining space by controlling ion density introduced to the three-dimensional ion confining space such that the amount of the ions does not substantially exceed a predetermined level based on the generated electric signal.

4. The three-dimensional quadrupole mass spectrometer according to claim 3, wherein the ion former is arranged outside of the three-dimensional ion confining space such that the ions formed by the ion former are introduced into the three-dimensional ion confining space, the detector is arranged between the ion former and the three-dimensional ion confining space and said restrictor changes a focusing condition of the ions introduced into the three-dimensional confining space based on the electric signal.

5. The three-dimensional quadrupole mass spectrometer according to claim 4, wherein the focusing condition of the ions is changed such that when the electric signal reaches said predetermined level, the electric signal does not substantially exceed the predetermined level and thereafter, when the electric signal becomes lower than the predetermined level, the changed focusing condition of the ions is recovered to a focusing condition of said ions before the focusing condition has been changed.

6. The three-dimensional quadrupole mass spectrometer according to claim 5, wherein said restrictor includes an electrostatic lens and a power supply for the electrostatic lens, and wherein an output from the power supply can be changed such that the focusing condition of the ions is changed based on the electric signal.

7. The three-dimensional quadrupole mass spectrometer according to claim 3, wherein the ion former is arranged outside of the three-dimensional ion confining space such that the ions formed by the ion former are introduced into the three-dimensional ion confining space, the detector is arranged between the ion former and the three-dimensional ion confining space and said restrictor changes an amount of the ions to be formed by the ion former based on the electric signal.

8. The three-dimensional quadrupole mass spectrometer according to claim 7, wherein the amount of the ions to be formed by the ion former is changed such that when the electric signal reaches the predetermined level, the electric signal does not exceed substantially the predetermined level and thereafter, when the electric signal starts falling from the predetermined level, the changed amount of said ions to be formed is recovered to an amount of said ions to be formed before the amount has been changed.

9. The three-dimensional quadrupole mass spectrometer according to claim 3, wherein the ion former is arranged outside of the three-dimensional ion confining space such that the ions formed by the ion former are introduced into the three-dimensional ion confining space, the detector is arranged between the ion former and the three-dimensional ion confining space and the ion former forms the ions substantially under an atmospheric pressure.

10. The three-dimensional quadrupole mass spectrometer according to claim 9, wherein an ionization under the atmospheric pressure is an ionization by corona discharge using a corona discharge electrode and a position of the corona discharge electrode is changed based on the electric signal.

11. The three-dimensional quadrupole mass spectrometer according to claim 10, wherein the position of the corona discharge electrode is changed such that when the electric signal reaches said predetermined level, the electric signal does not exceed substantially the predetermined level and thereafter, when the electric signal becomes lower than the predetermined level, the changed position of the corona discharge electrode is recovered to a position of the corona discharge electrode before the position has been changed.

12. The three-dimensional quadrupole mass spectrometer according to claim 9, wherein said restrictor changes a focusing condition of the ions introduced into the three-dimensional ion confining space based on the electric signal.

13. The three-dimensional quadrupole mass spectrometer according to claim 12, wherein the focusing condition of the ions is changed such that when the electric signal reaches said predetermined level, the electric signal does not substantially exceed the predetermined level and thereafter, when the electric signal becomes lower than the predetermined level, the changed focusing condition of the ions is recovered to a focusing condition of the ions before the condition has been changed.

14. A three-dimensional quadrupole mass spectrometer comprising:

an ion former for forming ions in a three-dimensional ion confining space;

electrodes for forming an electric field in the three-dimensional ion confining space;

a voltage controller for forming a three-dimensional quadrupole electric field by applying a periodic voltage to the electrodes such that said ions formed by the ion former are confined to the three-dimensional ion confining space; wherein the voltage controller controls the periodic voltage such that said ions having a desired mass/charge ratio are emitted from the three-dimensional ion confining space;

a detector for detecting an estimated amount of said ions in the three-dimensional confining space by detecting ions emitted from the three-dimensional ion confining space and generating an electric signal corresponding to the amount of the estimated amount of said ions existing in the three-dimensional ion confining region; and a restrictor restricting the amount of the ions existing in the three-dimensional ion confining space by controlling ion density introduced to the three-dimensional ion confining space such that the amount of the ions does not substantially exceed a predetermined level based on the generated electric signal.

15. The three-dimensional quadrupole mass spectrometer according to claim 14, wherein a sample is introduced into the three-dimensional ion confining space, the ion former forms electrons and causes the electrons to impinge on the introduced sample for ionization and the detector detects the ions existing in the three-dimensional ion confining space by detecting said ions emitted from the three-dimensional ion confining space.

16. The three-dimensional quadrupole mass spectrometer according to claim 15, wherein said restrictor changes an amount of the electrons to be generated or an amount of the sample to be introduced in response to the electric signal.

17. The three-dimensional quadrupole mass spectrometer according to claim 14, wherein an amount of the ions to be formed or an amount of the sample to be introduced is changed such that when the electric signal reaches said predetermined level, the electric signal does not substantially exceed the predetermined level and thereafter, when the electric signal becomes lower than the predetermined level, the changed amount of the ions to be formed or the changed amount of the sample to be introduced is recovered to an amount of the ions to be formed or an amount of the sample to be introduced before the electrical signal reaches the predetermined level.

18. The three-dimensional quadrupole mass spectrometer according to claim 14, wherein the detector includes means for detecting a degree of vacuum of the three-dimensional ion confining space to thereby provide the electric signal and an amount of the sample to be introduced is changed based on the electric signal.

19. The three-dimensional quadrupole mass spectrometer according to claim 18, wherein the amount of the introduced sample is changed such that when the electric signal reaches a predetermined level, the electric signal does not substantially exceed the predetermined level and thereafter, when the electric signal becomes lower than the predetermined level, the changed amount of the sample to be introduced is recovered to an amount of the sample to be introduced before the electrical signal reaches the predetermined level.

* * * * *